US012110085B2

(12) United States Patent
Allum et al.

(10) Patent No.: US 12,110,085 B2
(45) Date of Patent: Oct. 8, 2024

(54) UNDERWATER GLIDER

(71) Applicant: RON ALLUM DEEPSEA SERVICES PTY LTD, Epping (AU)

(72) Inventors: Ronald Charles Allum, Epping (AU); Alan Miguel Lavery, Epping (AU); Matthew Glen Johnston, Epping (AU)

( * ) Notice: Subject to any disclaimer, the term of this patent is extended or adjusted under 35 U.S.C. 154(b) by 431 days.

(21) Appl. No.: 17/622,711

(22) PCT Filed: Jun. 26, 2020

(86) PCT No.: PCT/AU2020/050670

§ 371 (c)(1),
(2) Date: Dec. 24, 2021

(87) PCT Pub. No.: WO2020/257879

PCT Pub. Date: Dec. 30, 2020

(65) Prior Publication Data

US 2022/0250726 A1 Aug. 11, 2022

(30) Foreign Application Priority Data

Jun. 26, 2019 (AU) ..... 2019902248

(51) Int. Cl.

| | |
|---|---|
| ***B63G 8/04*** | (2006.01) |
| ***B63B 1/24*** | (2020.01) |
| ***B63B 1/26*** | (2006.01) |
| ***B63B 5/24*** | (2006.01) |

(52) U.S. Cl.

CPC ..... *B63G 8/04* (2013.01); *B63B 1/248* (2013.01); *B63B 1/26* (2013.01); *B63B 5/24* (2013.01)

(58) Field of Classification Search

CPC .. B63B 1/248; B63B 1/26; B63B 5/24; B63B 2207/02; B63B 2211/02; B63B 2241/02; B63B 2241/22; B63B 2241/24; B63G 8/04; B63G 8/18; B63G 8/26; B63G 8/22; B63G 2008/00; B63G 8/001; B63G 2008/005

USPC ..... 114/312, 313, 317, 330, 331, 333

See application file for complete search history.

(56) References Cited

U.S. PATENT DOCUMENTS

| | | | | |
|---|---|---|---|---|
| 6,901,876 | B2 * | 6/2005 | Geriene | B63G 8/42 114/244 |
| 8,127,704 | B2 * | 3/2012 | Vosburgh | B63G 8/42 114/245 |
| D844,534 | S * | 4/2019 | Liu | D12/308 |
| 2020/0062386 | A1 * | 2/2020 | Zhang | B64C 29/0033 |

FOREIGN PATENT DOCUMENTS

| | | | | |
|---|---|---|---|---|
| CN | 106043634 | A * | 10/2016 | |
| CN | 108860529 | A * | 11/2018 | |
| CN | 109250054 | A * | 1/2019 | B63G 8/08 |
| WO | WO-2012085590 | A2 * | 6/2012 | B63B 1/047 |
| WO | WO-2019079930 | A1 * | 5/2019 | B60F 5/02 |

* cited by examiner

*Primary Examiner* — Daniel V Venne
(74) *Attorney, Agent, or Firm* — Darren Gardner

(57) ABSTRACT

In an underwater glider, stability and versatility can be enhanced by the use of a high wing design. In a high wing design, a centerline of the wings extending from the sides of the body of the glider are located above a relative centerline of the body of the glider. The relative centerline of the wings may rise continuously from a region where the wings attach to the body to respective ends of the wings. In particular for a blended wing glider, a top surface of the glider is level in a line extending between ends of each wing.

15 Claims, 12 Drawing Sheets

UNDERWATER GLIDER

FIELD OF THE INVENTION

This application relates generally to underwater vehicles which may include unmanned underwater vehicles (UUV), also known as autonomous underwater vehicles (AUV), as well as manned underwater vehicles. The disclosure has specific application to vehicles referred to as blended wing gliders, but may also have application to designs that are not considered as blended wing.

BACKGROUND OF THE INVENTION

Underwater gliders have the ability to travel through water to significant depths. The gliders are relatively quiet and can travel long distances on minimal fuel. These benefits allow gliders to be used for a range of purposes, including oceanographic science activities, military and defense applications, etc.

An underwater glider typically includes a fuselage or body that supports wings or hydrofoils either side of the fuselage. The fuselage and/or wings may house a drive system, typically a variable buoyancy engine. The variable buoyancy engine changes the overall buoyancy of the vehicle causing the vehicle to dive or surface accordingly. The angle of attack of the hydrofoil causes the vehicle to glide forwards as it moves up and down through the water, allowing the vehicle to attain velocities appropriate to its purpose. Once a suitable velocity is obtained a steady forward motion at a steady depth can be achieved by adjusting the trim of the vehicle.

To achieve prolonged autonomous operation of the vehicle, balance of the vehicle is essential. However, the hydrodynamic balance requirements of existing underwater gliders can often be at odds with the other functional requirements of the vehicle. Therefore, what is required is an improved underwater glider design.

SUMMARY OF THE INVENTION

In an underwater glider, stability and versatility can be enhanced by the use of a high wing design. In a high wing design, a centerline of the wings extending from the sides of the body of the glider are located above a relative centerline of the body of the glider. The relative centerline of the wings may rise continuously from a region where the wings attach to the body to respective ends of the wings. In particular for a blended wing glider, a top surface of the glider is level in a line extending between ends of each wing.

In one aspect of the disclosure, there is provided an underwater glider including a body and first and second wings extending from respective first and second sides of the body. A relative centerline of the first and second wings at any point along the first and second wings is disposed above a relative centerline of the body.

In one embodiment, a relative centerline of the wing rises continuously from the body toward a tip of the respective wing.

In one embodiment, each wing is substantially symmetrical about the relative centerline along the length of the respective wing.

In one embodiment, a top surface of the glider is level in a line extending between ends of each wing.

In one aspect of the disclosure, there is provided an underwater glider including a body and first and second wings that extend from the body. For each of the first and second wings, a relative centerline of the respective wing rises continuously from the body toward a tip of the respective wing.

BRIEF DESCRIPTION OF THE DRAWINGS

Reference will now be made, by way of example only, to specific embodiments and to the accompanying drawings in which.

DETAILED DESCRIPTION OF THE INVENTION

As stated above, balance of a glider is essential for long, stable operation. Unlike air gliders which, being heavier than are only required to glide downwards after being towed into the air, underwater gliders are near neutral density to their environment so they can ascend or descend by making changes to buoyancy. The change is generally very small when compared to the total displacement of the vehicle. This makes the vehicle very susceptible to instability if the center of mass is incorrect or inadequate with respect to vehicle center of displacement. For optimal balance, current underwater gliders are believed to require the wings or hydrofoils to be centered on a horizontal plane through a horizontal center of the body or fuselage. However, the present inventors have found that particular advantages may be achieved with a high wing design as will be herein described.

When a glider is not in the water, the glider tilts and rests on an undersurface of the wing and body. Equipment such as sensors for ocean surveys, cameras, etc. may be located on the undersurface of the wing and can be damaged while the glider is in transit. Launch and recovery of the glider can also be problematic. Such disadvantages may also be reduced with the high wing design to be described herein.

Figure 1:
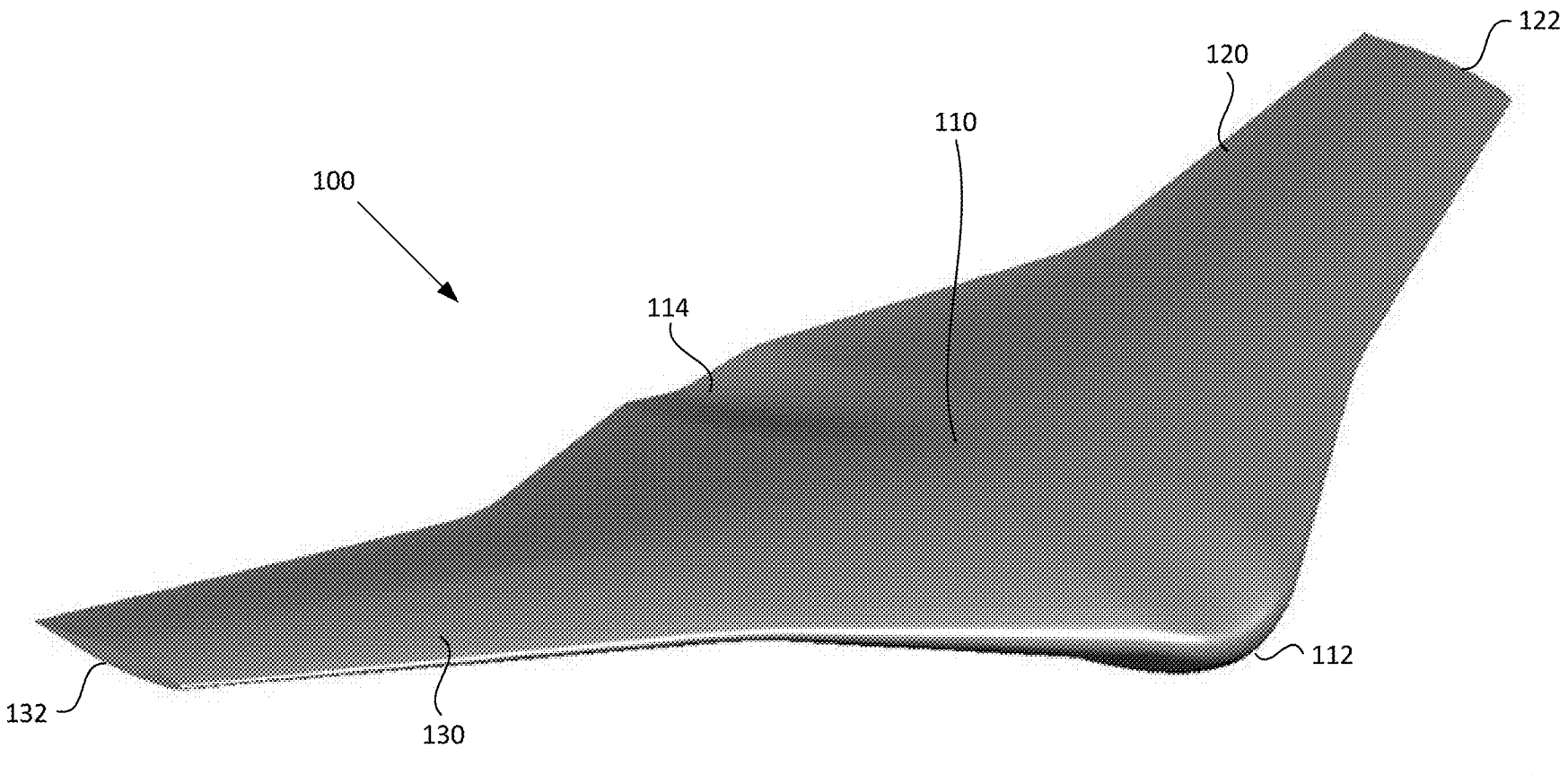
FIG. 1 shows a top perspective view of one embodiment of an underwater glider.
Figure 2:
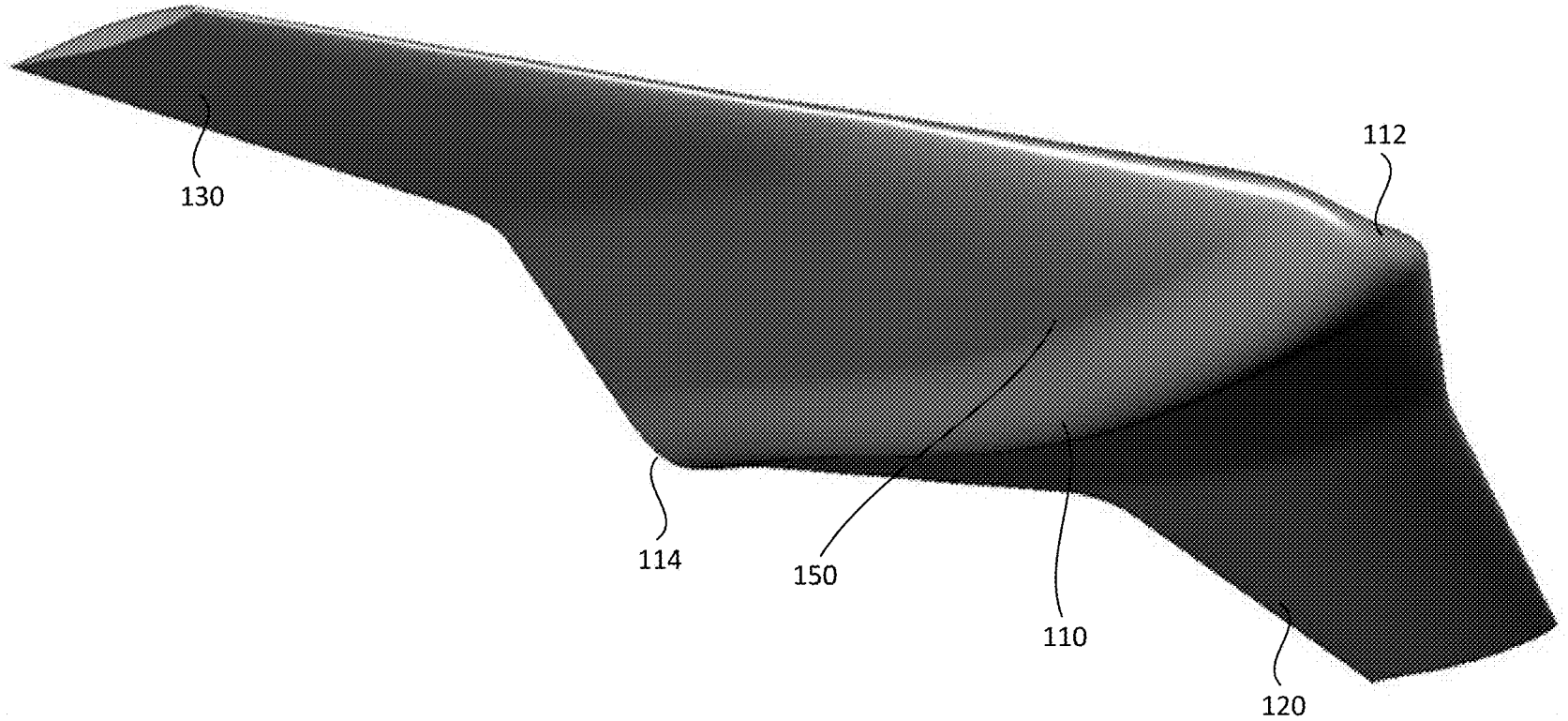
FIG. 2 shows a bottom perspective view of the underwater glider of FIG. 1.
Figure 3:
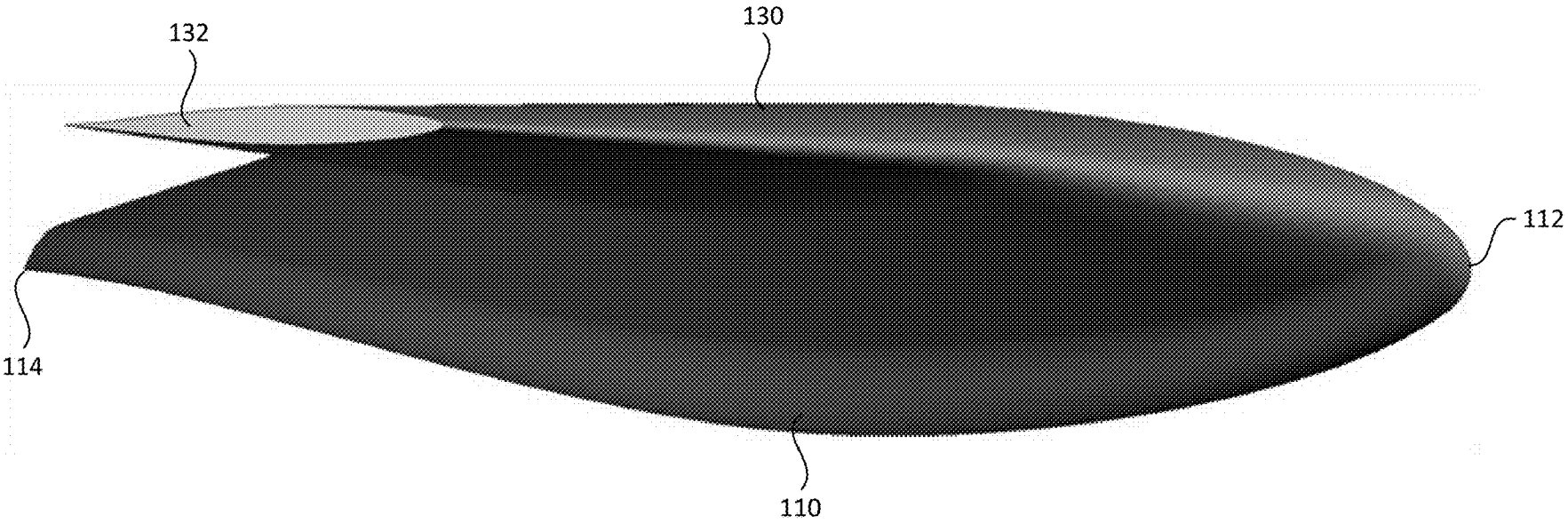
FIG. 3 shows a side view of the underwater glider.

FIG. 1 shows a top perspective view of a glider in accordance with an embodiment of the present disclosure that has been designed to overcome one or more problems of the gliders of the prior art. FIG. 2 shows a bottom perspective view of the glider 100 while FIG. 3 shows a side view.

The glider 100 includes a body 110. The body 110 is generally a wing profile having a front or nose 112 and tail 114. Extending from the sides of the body 110 are left and right wings or hydrofoils 120, 130. Each wing extends from the body 110 to a respective wing tip 122, 132. The glider 100 is a blended wing design. The term blended wing refers to there being no clear dividing line between the wings and the body of the glider. The fuselage itself forms part of the hydrodynamic surface. That is, the wing and body structure are smoothly blended together. This is shown in FIGS. 1 and 2 as the smooth transition between the body 110 and wings 120, 130. While a blended wing design will be described herein, the concepts to be described may also apply to gliders that have a separate body (usually a cylinder) with attached wings. Such gliders will be known to the person skilled in the art.

The body 110 and wings 120, 130 of an underwater glider may be made of a syntactic foam which has the properties of low density, low compressibility and high strength, making it suitable for deep sea usage. Syntactic foams are known in the art and no further description of such materials is considered necessary for the present disclosure.

Figure 4:
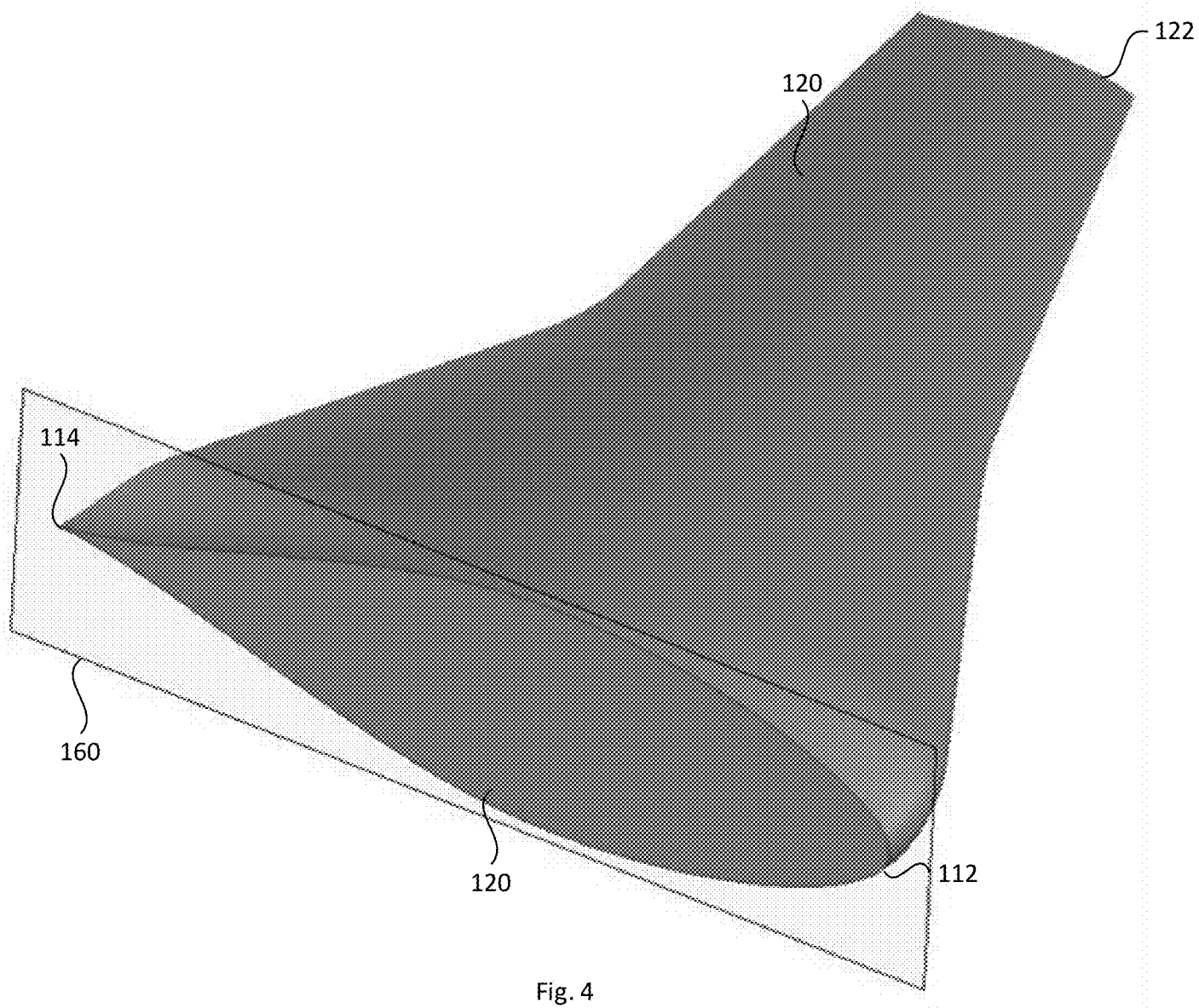
FIG. 4 shows a perspective of a vertical section on a longitudinal axis of the glider.

FIG. 4 shows a perspective view of a vertical section 160 through the body 110 along a longitudinal centerline of the glider 100 that extends from the nose 112 to the tail 114. The section is shown in side view in FIG. 5. The body 110 has a generally tear drop shape. It should be noted that the body 110 and wings 120, 130 may include one or more cavities (not shown) that house components of the vehicle. Components may include the variable buoyancy engine, associated control components, as well as purpose specific components such as sensors and control electronics, payloads, etc.

The present disclosure is concerned primarily with the outer hydrodynamics and configuration of the vehicle. The internal configuration of the body, location of the variable buoyancy engine and control electronics etc. are not considered pertinent to the present disclosure. The person skilled in the art will readily understand that variations to the internal layout and design of the glider will be dependent on a range of factors including mass placement (as it changes center of mass), size, purpose, extraneous equipment requirements, range, etc. Thus, the section views of FIGS. 4 and 5 are for the purpose of illustrating the outer shape of the body rather than any internal aspects.

Figure 5:
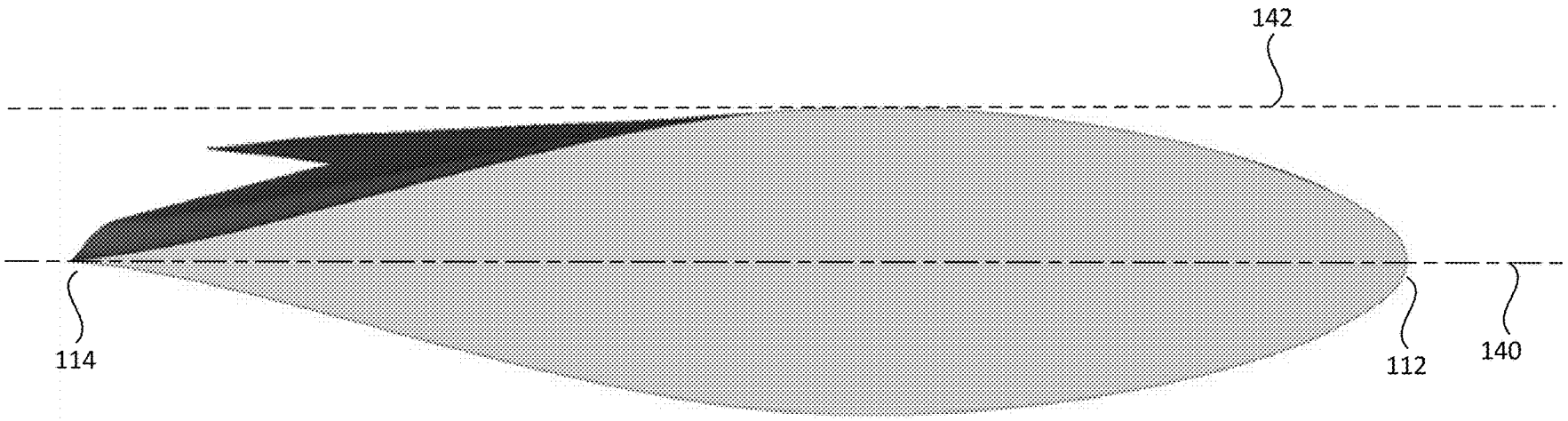
FIG. 5 shows a side view of the section of FIG. 4.

FIG. 5 shows a line 140 representing a horizontal plane through the center of the body 110. At the longitudinal axis represented by the section shown in FIG. 5, the body 110 is substantially symmetrical above and below the center plane 140.

FIG. 5 shows a second line 142 that represents a horizontal plane that is tangential with an apex of the body's tear drop profile.

Figure 6:
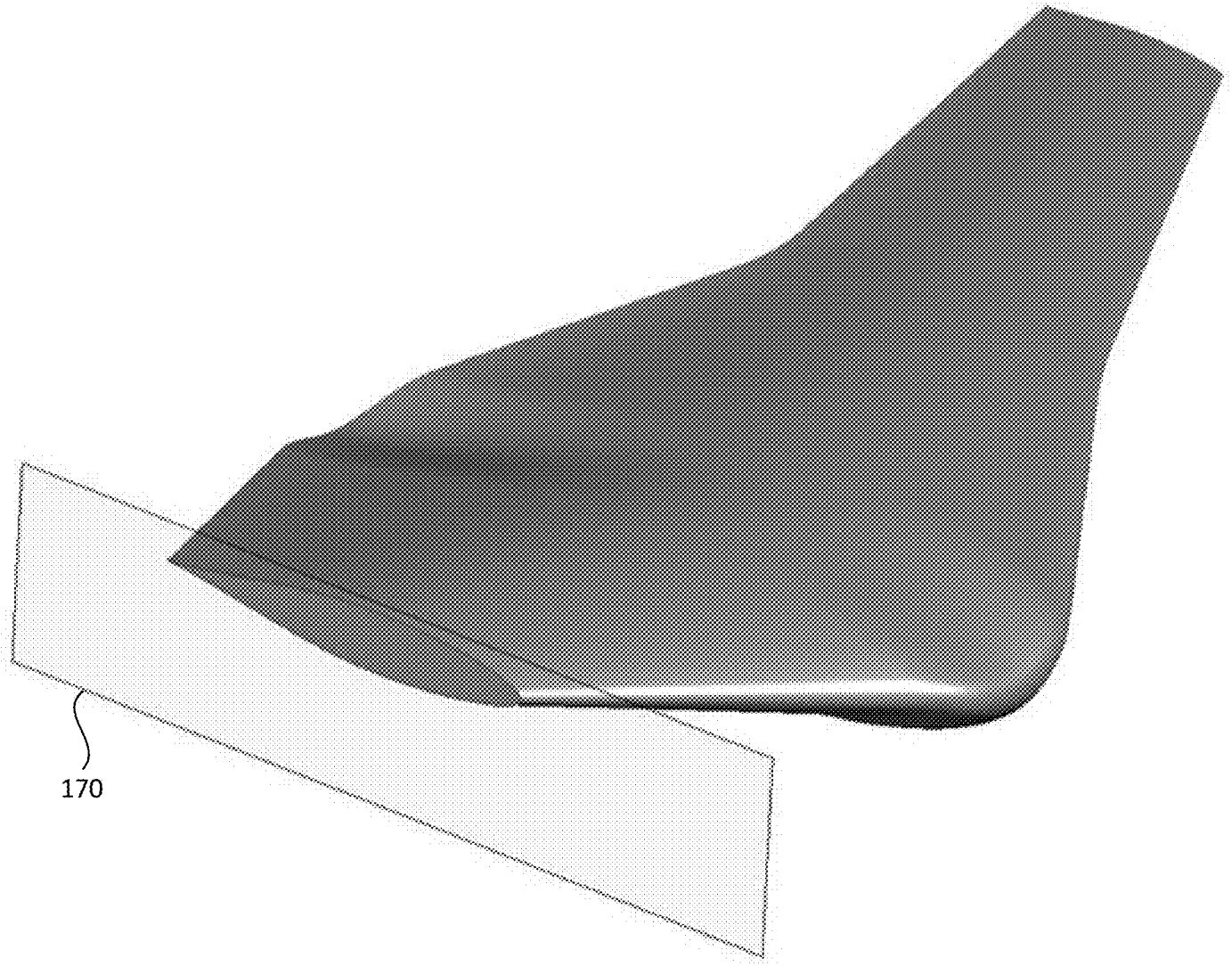
FIG. 6 shows a perspective of a vertical section on a plane parallel to the longitudinal axis, the plane located approximately half way along the wing.
Figure 7:
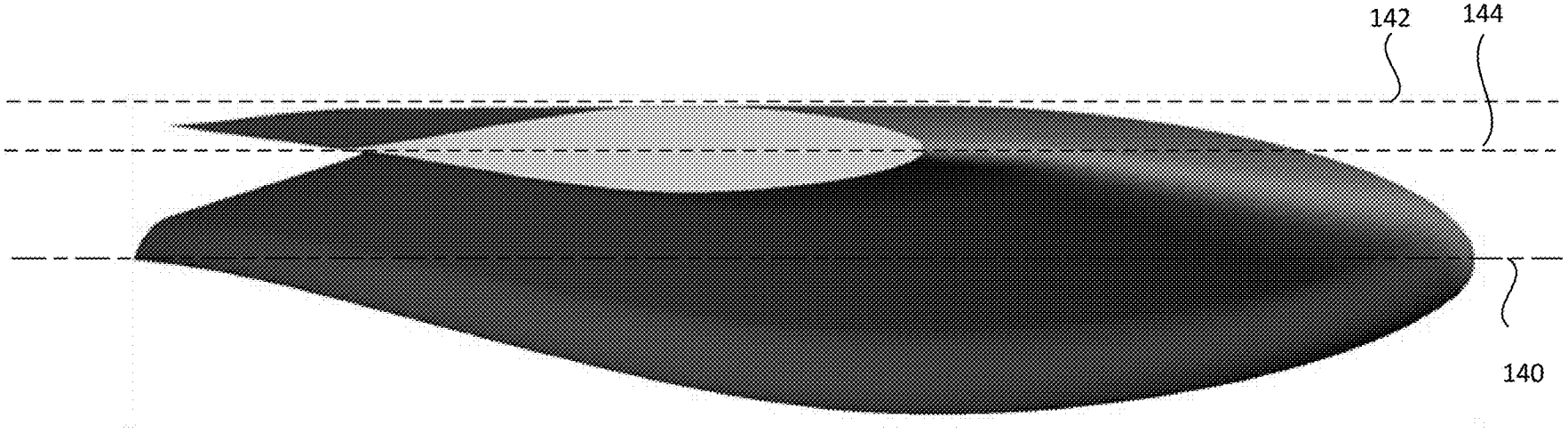
FIG. 7 shows a side view of the section of FIG. 6.

FIG. 6 shows a vertical section, parallel to the section of FIGS. 4 and 5 at an approximate midpoint along the right wing 130. FIG. 7 shows the section of FIG. 6 in side view.

FIG. 7 shows the centerplane 140 of the body section 110 and the apex plane 142. FIG. 7 further shows a relative centerline 144 of the wing 130 at the point of the section. It can be seen in FIG. 7, that the wing remains substantially symmetrical above and below the relative centerline 144. It can further be seen that the relative centerline 144 is disposed above the centerplane 140 of the body 110.

The present applicants and inventors refer to the configuration of the glider depicted herein as a high-wing design. That is, rather than the wing being centered on the body, as is the case for conventional underwater glider design, particularly blended wing gliders, the relative centerline of the wing at any point is disposed above the centerplane of the body.

An alternative manner for considering the wing profile depicted is that a relative centerline of the wing rises continuously from the region where the wing extends from the body toward a tip of the respective wing. This may be an appropriate consideration particularly for non-blended wing glider designs.

In one embodiment, the wing profile is substantially symmetrical along its length. That is, for any section, the wing profile is mirrored above and below the relative centerline. This allows wing lift at various angles of attack in both ascent and descent to be equally effective. In an alternative embodiment, the wing may have a non-symmetrical design. For example, the wing may have a flexible profile, where the profile is distorted one way in ascent and the other way in descent. Non-symmetry may also be intentional to achieve greater efficiency in ascent or descent as required.

Figure 8:
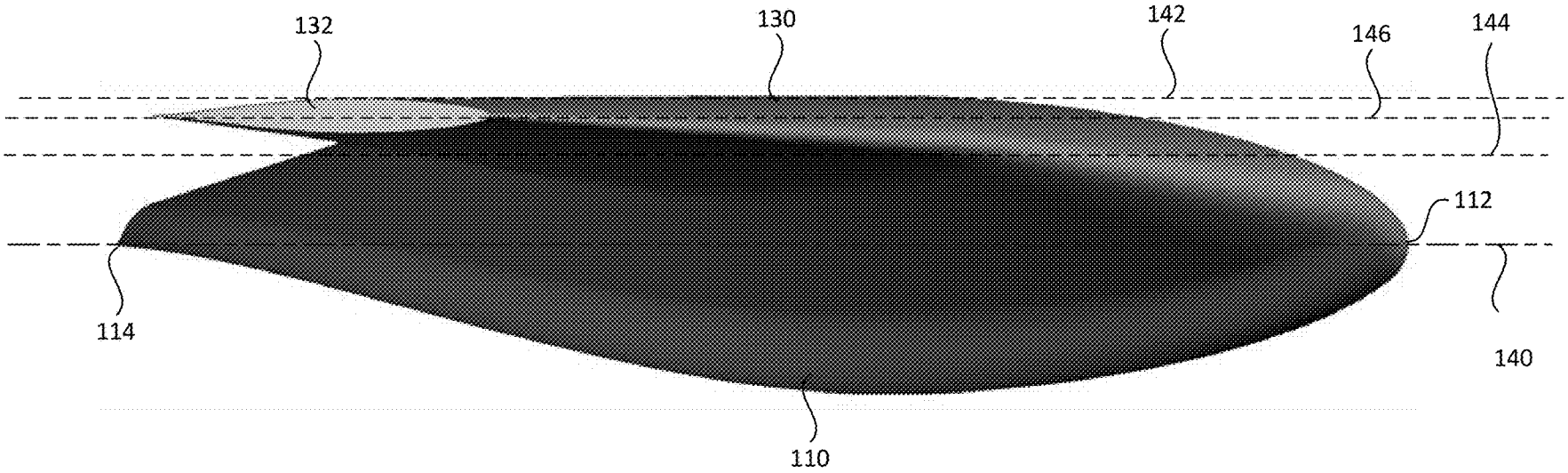
FIG. 8 shows the side view of FIG. 3 with additional relative centerlines of the wing.

In one embodiment, the relative centerline rises continuously from its lowest at the longitudinal axis of the body (FIG. 5) to its highest at the wing tip. That is, the relative centerline rises continuously in the direction from the longitudinal axis of the body 110 to the wing tips. FIG. 8 shows the same end view of FIG. 3 with the relative centerline 146 of the end of the wing illustrated. FIG. 8 further shows the centerplane 140 and the position of the relative centerline 144 from the section shown in FIG. 7 to demonstrate that the relative centerlines continuously rise from the centerplane 140 to the wing tip 146.

Figure 9:
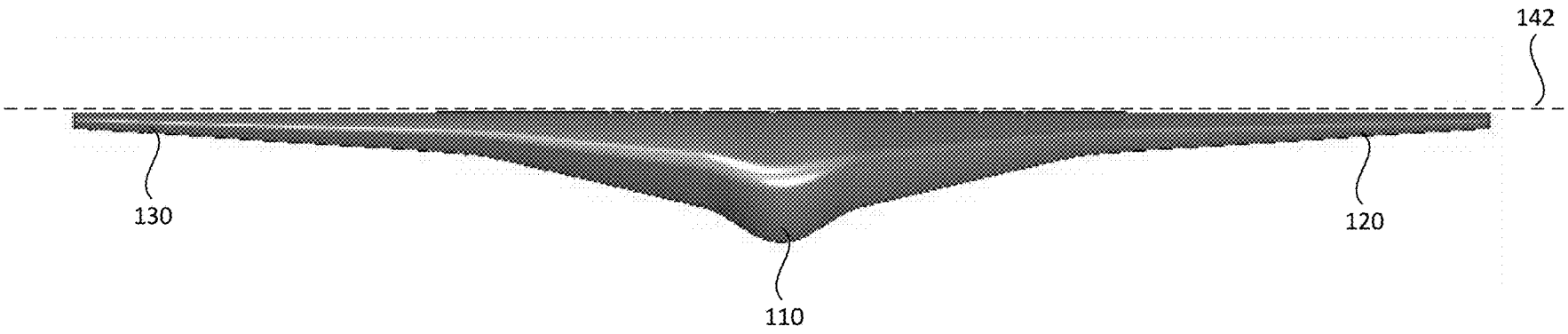
FIG. 9 shows a front view of the glider demonstrating a level top line extending between the ends of the wings.

Returning again to FIG. 5, it can be seen that for the body section, the apex of the body touches the tangential plane 142. In FIG. 7, it is seen that for the wing section, the apex of the wing also touches the apex plane 142. This is also seen at the end of the wing shown in FIG. 8. That is, the apex of the wing is horizontal along its length, giving the glider a level top from wing tip to wing tip. The level top of the glider is shown in the front view of FIG. 9.

Figure 10:
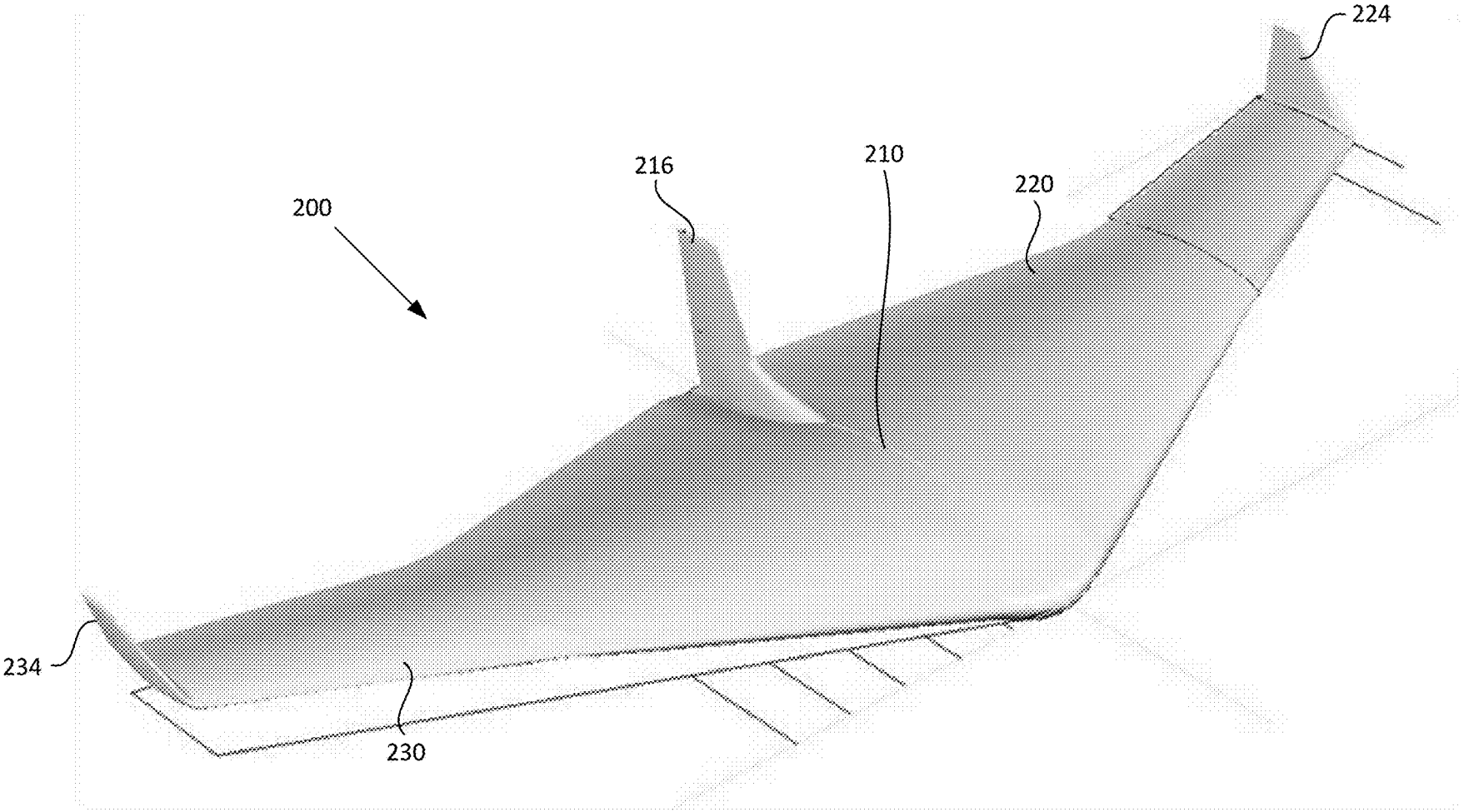
FIG. 10 shows a top perspective of an alternative high-wing underwater glider with wing tips and tail fin.
Figure 11:
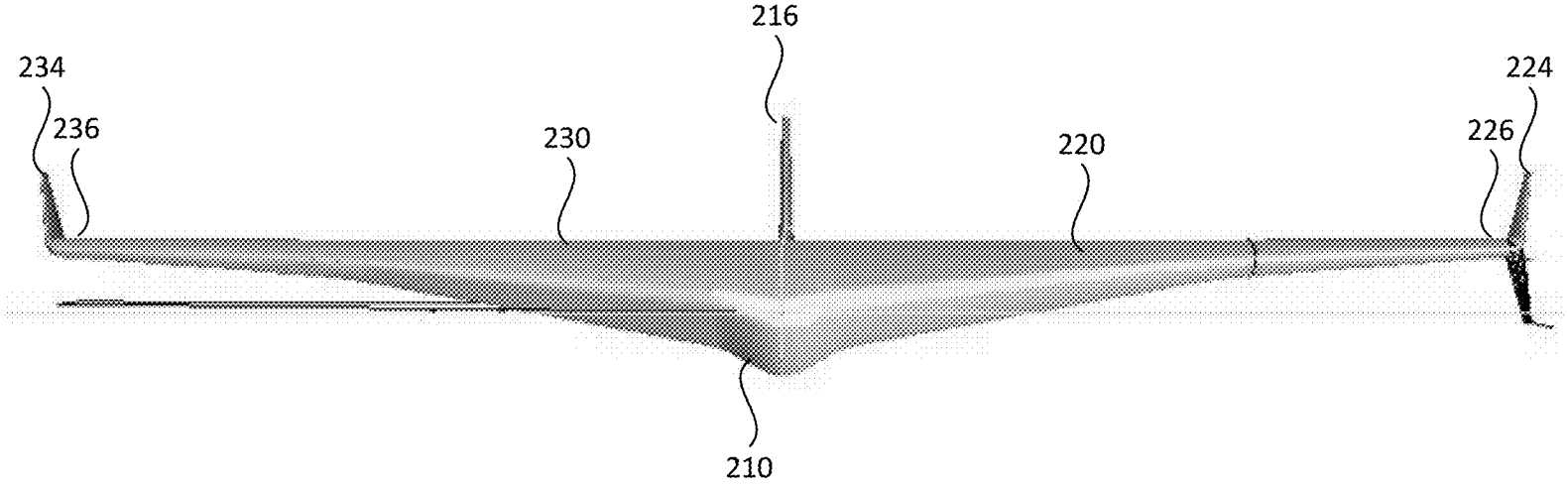
FIG. 11 shows a front view of the glider of FIG. 10.

In FIG. 10 and there is shown respective and front views of an alternative embodiment of an underwater glider 200. The glider 200 has a body 210, left wing 220 and right wing 230. The body 210 and wings 220, 230 may have similar high wing profiles and designs to the glider 100 described above. The glider is modified to include upturned winglets 224, 234 that extend upwards from the ends of the wings 226, 236. In some embodiments, the winglets 224, 234 may enhance any of stability, lift and drag. The glider 200 may also be provided with an upwardly extending tail fin 216 which may improve stability at the expense of lift and drag benefits. The tail fin may be desirable as a communications/observation tower to relocate the vehicle on surfacing by RF and/or by visual strobe means. The front view of FIG. 11 shows that between the ends 226 and 236 of the wings 220, 230, i.e. excluding the upturned wing tips 224, 234, the glider maintains the arrangement where the apex of the wing is horizontal along a line extending between the ends of the wings, similar to the configuration of FIG. 9.

The high wing design as described herein can provide enhanced stability benefits over conventional underwater gliders. In particular, the high-wing design described herein enables a greater righting moment to be achieved to improve stability.

An advantage of the high wing design of the presently described embodiments includes that the design allows safer and greater flexibility to add side-scan or bottom profiling transducers/instruments to a blended wing glider designed underwater vehicle. FIG. 2 depicts a location 150 for such equipment to be disposed, being in the area below the wing substantially in the area where the wing blends with the body. This region is the most protected area during launch and recovery and when the glider is resting on a surface.

This region is larger and more protected than an equivalent region of a center wing design.

Higher wings will be further from the ship deck during launch and recovery, providing protection to the wings and any sensor or purpose-specific equipment mounted thereto. A further advantage during launch is that a greater vehicle mass will enter the water first, allowing the vehicle to become more stable before more vulnerable extremities enter the water. The opposite in recovery is also an advantage.

In one embodiment, solar panels may be added to the upper side of the wings. Solar panels may be used as emergency power, for example, for recovery beacon operation.

Figure 12:
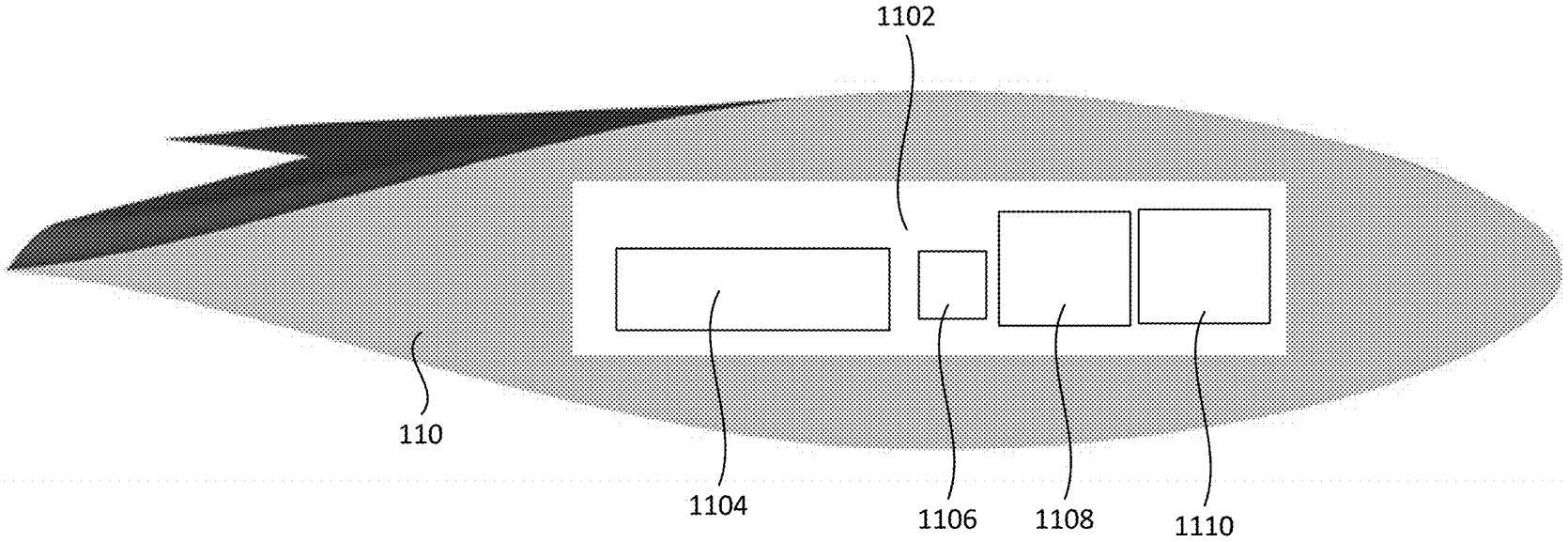
FIG. 12 shows a vertical section on a longitudinal axis of the glider and schematically depicts internal components of the glider.

A glider as herein described may be equipped and configured for a range of purposes. FIG. 12 shows a section through the body of the glider to schematically depict internal components of the body 110. The body 110 may include one or more cavities 1102 formed within the syntactic foam or other material of the body 110. The cavity houses functional components of the glider. One or more ports or hatches (not shown) may provide access to the one or more cavities 1102. A variable buoyancy engine 1104 may be disposed within the cavity 1102. The variable buoyancy engine provides the driving force for the glider by causing the glider to sink or rise in a forward direction along a glide plane set by the trim of the glider. Alternative drive mechanisms may also be utilized. Control components 1106 such as electronics, batteries, etc. may be housed in association with the engine 1104. The glider may be provided with on board survey equipment or similar scientific equipment 1108. The glider may also house a payload 1110. Additional equipment, including survey and scientific equipment, payload, etc. may also be located on one or more exterior surfaces of the glider as required.

FIG. 12 only schematically depicts the presence of the cavities and equipment. The specific location of these components will depend on the particular deployment and utilization of the glider, with locations selected to provide balance and trim for the glider.

It will be understood by the person skilled in the art that terms of orientation such as top, bottom, front, back, left, right, inner, outer, horizontal, vertical etc. are used herein with reference to the drawings in order to provide a clear and concise description. Such terms indicate examples of the relative relationship of components to each other, rather than specific orientations of those components in space. These terms are not intended to limit the examples and embodiments in any manner and the scope of the disclosure as defined herein will encompass other possible orientations of the components as will be perceived by the person skilled in the art.

Although embodiments of the present invention have been illustrated in the accompanied drawings and described in the foregoing description, it will be understood that the invention is not limited to the embodiments disclosed, but is capable of numerous rearrangements, modifications, and substitutions without departing from the spirit of the invention as set forth and defined by any claims that follow.

What is claimed is:

1. An underwater glider including:

a body, first and second wings extending from respective first and second sides of the body;

wherein a relative centerline of the first and second wings at any point along the first and second wings is disposed above a relative centerline of the body; and wherein a top surface of the underwater glider is level in a line extending between ends of each of the first and second wings.

2. The underwater glider of claim 1 wherein the body includes a wing profile.

3. The underwater glider of claim 1 wherein, for each of the first and second wings, a relative centerline of the respective wing rises continuously from the body toward a tip of the respective first and second wing.

4. The underwater glider of claim 1 wherein each of the first and second wings is symmetrical about the relative centerline along a length of the respective first and second wing.

5. The underwater glider of claim 1 including a variable buoyancy engine.

6. The underwater glider of claim 1 wherein the body includes a syntactic foam.

7. The underwater glider of claim 1 wherein the underwater glider includes a blended wing design.

8. An underwater glider including:

a body, first and second wings that extend from the body;

wherein for each of the first and second wings, a relative centerline of the respective wing rises continuously from the body toward a tip of the respective wing; and wherein the glider includes a blended wing design.

9. The underwater glider of claim 8 wherein a relative centerline of the first and second wings at any point along the first and second wings is disposed above a relative centerline of the body.

10. The underwater glider of claim 8 wherein the body includes a wing profile.

11. The underwater glider of claim 8 wherein each of the first and second wings is symmetrical about the relative centerline along a length of the respective wing.

12. The underwater glider of claim 9 wherein a top surface of the underwater glider is level in a line extending between ends of each of the first and second wings.

13. The underwater glider of claim 8 including a variable buoyancy engine.

14. The underwater glider of claim 8 wherein the body includes a syntactic foam.

15. An underwater glider including:

a body, first and second wings extending from respective first and second sides of the body;

wherein a relative centerline of the first and second wings at any point along the first and second wings is disposed above a relative centerline of the body;

and wherein the body includes a wing profile.

* * * * *